US007856910B2

(12) United States Patent
Kwok

(10) Patent No.: US 7,856,910 B2
(45) Date of Patent: Dec. 28, 2010

(54) METHOD OF BALANCING A KITCHEN KNIFE USING REMOVABLE HANDLE WEIGHTS

(75) Inventor: Ngok Wing Kwok, Vancouver (CA)

(73) Assignee: Golden Sun Home Products Limited (HK)

( * ) Notice: Subject to any disclaimer, the term of this patent is extended or adjusted under 35 U.S.C. 154(b) by 92 days.

(21) Appl. No.: 11/773,459

(22) Filed: Jul. 5, 2007

(65) Prior Publication Data

US 2009/0007434 A1 Jan. 8, 2009

(51) Int. Cl.
*B26B 3/00* (2006.01)
*B25G 1/00* (2006.01)

(52) U.S. Cl. ..... 83/13; 30/125; 30/314; 30/340; 16/111.1; 81/489

(58) Field of Classification Search ..... 30/125, 30/123, 136, 136.5, 142, 314, 317, 340, 342–344; 16/110.1, 111.1; 76/104.1, 106; 81/489, 81/490; 83/13
See application file for complete search history.

(56) References Cited

U.S. PATENT DOCUMENTS

| | | | | | |
|---|---|---|---|---|---|
| 136,499 | A * | 3/1873 | Gaches | 30/125 |
| 149,833 | A * | 4/1874 | Brown et al. | 30/125 |
| 229,219 | A * | 6/1880 | Wilson | 279/105 |
| 648,265 | A * | 4/1900 | Von Jaraczewski | 30/344 |
| 874,583 | A * | 12/1907 | Garret | 30/365 |
| 1,092,529 | A * | 4/1914 | Horn | 223/104 |
| 1,342,383 | A * | 6/1920 | Horvath | 30/304 |
| 2,615,247 | A * | 10/1952 | Waters | 30/342 |
| 4,030,194 | A * | 6/1977 | Hendricks | 30/143 |
| 4,470,327 | A * | 9/1984 | Gerber et al. | 76/104.1 |
| 4,669,186 | A * | 6/1987 | Liu | 30/125 |
| 5,402,578 | A * | 4/1995 | Whitman et al. | 30/344 |
| 6,195,899 | B1 * | 3/2001 | Watanabe | 30/340 |
| 6,419,371 | B1 * | 7/2002 | McCalla et al. | 362/119 |
| 6,434,836 | B1 * | 8/2002 | Olivares | 30/277.4 |
| 6,640,445 | B1 * | 11/2003 | Crawford | 30/277.4 |
| 6,782,626 | B1 * | 8/2004 | Gibbs | 30/342 |
| 7,305,908 | B2 * | 12/2007 | Chi et al. | 81/177.4 |
| 2003/0221323 | A1 * | 12/2003 | DeAsis et al. | 30/329 |
| 2006/0096102 | A1 * | 5/2006 | DeAsis et al. | 30/342 |
| 2009/0158600 | A1 * | 6/2009 | Ishai | 30/314 |

FOREIGN PATENT DOCUMENTS

| | | | |
|---|---|---|---|
| DE | 3315768 | A1 | 10/1984 |
| DE | 202006017812 | U1 | 3/2007 |
| EP | 1016507 | A1 | 7/2000 |
| GB | 177344 | | 3/1922 |
| JP | 2006-110165 | * | 4/2006 |

OTHER PUBLICATIONS

European Search Report dated Nov. 15, 2007 pertaining to European Application No. 07252953.0.

* cited by examiner

*Primary Examiner*—Clark F. Dexter
(74) *Attorney, Agent, or Firm*—Dinsmore & Shohl LLP

(57) ABSTRACT

A knife with a handle capable of adjustable weight configurations. The handle is hollow such that the weight balance between the handle and blade may be adjusted through the selective use of one or more removable weights that form part of an axially oriented weight mounting assembly. A user may add or remove weights until a desired knife balance is achieved.

9 Claims, 5 Drawing Sheets

METHOD OF BALANCING A KITCHEN KNIFE USING REMOVABLE HANDLE WEIGHTS

BACKGROUND OF THE INVENTION

This invention relates generally to improved cutlery, and more particularly to a kitchen knife that has interchangeable weights so that a user can adjust the balance and feel of the knife.

Knives and related cutlery devices are common tools in both private and commercial kitchens. Typically, a kitchen knife includes a blade attached to or formed integral with a handle through a tang. The handle forms the main grasping surface, while the blade forms the cutting surface along a sharpened cutting edge along its length. An opposing edge of the blade is flattened or blunted to allow a user to place a hand for additional guidance or support of the knife during use.

Weight imbalances can cause user fatigue over extended use periods, even in situations where the imbalance is relatively small. While both private and commercial users may use a knife for such extended periods, the problem is especially acute in commercial environments. In a typical fixed knife configuration, the center of gravity is located at or near the center of the handle portion and cannot be changed. Such inflexibility limits the utility of the knife, especially over periods of prolonged use. What is desired is a knife that can maintain a proper weight balance under different use conditions. What is further desired is a knife that can have its balance easily adjusted.

SUMMARY OF THE INVENTION

These desires are met by the present invention, where a kitchen knife capable of easy user-defined balancing is disclosed. With this preferred arrangement, the overall weight balance of the knife can be optimized, thereby reducing the onset of user fatigue. Such is especially valuable in commercial kitchen applications, where a user may be working with the knife for hours at a time.

According to a first aspect of the invention, a kitchen knife includes a metal blade, a handle with a hollow compartment, one or more removable weights and a weight mounting assembly that cooperates with the handle to allow the weights to be secured within the hollow compartment. The blade includes a sharp cutting edge and a blunted edge opposite the cutting edge. The handle is connected to the blade, while the weight mounting assembly can engage the handle at an end of the handle that is substantially opposite of the end of the handle nearest the blade. In this way, once a user has placed the weight or weights into a desired axial location within the hollow compartment, the weight mounting assembly can effect an axially balanced configuration suitable to the user's particular needs.

Optionally, the blade can be made from a suitable cutting material, such as a high carbon or otherwise alloyed steel. Similarly, a material making up the handle can be the same material, or can be a stainless steel. The one or more weights may be disposed in the hollow compartment such that balanced knife configuration occurs mainly along a substantially lengthwise direction of the handle. In one form, the handle engages the weight mounting assembly through a permanent connection, for example, welding a ring or related mount to the handle. In addition, the one or more weights may be, in situations where multiple weights are used, axially disposed relative to one another within the hollow compartment. The weight mounting assembly may be formed from numerous components, including a stopper or related main structural member that threadably or otherwise engages the ring or related mount that (through the aforementioned welding) is directly and permanently affixed to one or both of inner and rear surfaces of the handle, and an end cap or cover that is attached to the stopper. The stopper functions as an anchor for a generally axial rod, post or screw upon which the weight or weights (which could have complementary threaded bores formed through them) can be secured in a preferred axial place. The cover can be used to substantially close off the remaining components from the ambient environment once the weight mounting assembly is placed within the handle, and may be attached to the stopper in such a way that insertion or removal of the end cap (by screwing or unscrewing) of it produces sympathetic movement in the stopper which, by virtue of its threaded relationship with the ring or similar mount, can be inserted or removed by the screwing or unscrewing motion. Preferably, movement of the stopper and end cap is rotational, so that such rotational movement in one produces comparable rotational movement in the other. In addition, one or more indexing devices can be placed on the rod to cooperate with it to keep the weights disposed on the rod in a fixed axial location thereon. The weight mounting assembly allows relatively precise placement of the weight or weights in accordance with a preferred balance, heft or related feel as desired by the user. In another option, the handle may include protuberances on the outer surface thereof to promote improved user grip. Such construction is beneficial in avoiding having the knife slip in the user's hand.

According to another aspect of the invention, a kitchen knife including a metal blade with a cutting edge, a handle integrally defining an axially elongate hollow compartment and one or more removable weights disposable in the hollow compartment is disclosed. The cooperation between the weight and the hollow compartment is such that upon placement of the weight in the hollow compartment, a predetermined balance characteristic of the knife can be established. By being integrally constructed, the handle and the blade define a single, one-piece (i.e., unitary) structure, rather than being fastened or adhesively glued together. Such unitary construction, which may be achieved by forming the handle and blade from a single piece of material, or by welding the two together along with post-weld machining, is not only more structurally robust, but also minimizes gaps or like locations on the outer surface of the knife that can provide a breeding ground for bacteria or other contaminants.

The handle includes a proximal end and a distal end such that in a preferred embodiment, the hollow compartment terminates at the proximal end and the blade joins the handle at the distal end. The knife may further include a weight mounting assembly configured in a manner generally similar to that discussed above in conjunction with the previous aspect. Closure of the proximal end of the handle occurs with the end cap, which (in a manner similar to that discussed above) when in place closes off access to the hollow compartment that terminates at the proximal end of the handle. As previously stated, a stopper may be threaded so that it engages the handle as a device that can be screwed on or off by movement imparted to it through the end cap. In addition, a rod may be axially disposed within the hollow compartment. The rod may further be in the form of a tube, post or screw and aligned along the handle's axial dimension. To enhance cooperation between the weights and the rod, the weights may have a substantially axial bore formed through them such that they can engage the rod through the substantially axial bore. Connection between the bore and rod may be through slip fit, friction fit or threaded relationship, the latter where complementary threads promote a nut-and-bolt like fit between them. In a slip fit configuration, the weights may be held in a preferred axial place by protrusions on the rod, or by sleeves (for example, tight-fitting rubber tubes) that can fit on the outer surface of the rod and remain in place by frictional contact, adhesive or other fastening or other means. Threaded cooperation between various components such as the stopper and a complementary surface on the handle (or a stopper-engaging mount, such as a ring, affixed to the surface of the handle) is such that ease of access to the hollow compartment through unscrewing the stopper is promoted. Likewise, screwing the stopper into the complementary threads on the mount or handle makes it easy to put the knife back together again once the desired weight balance is established.

According to yet another aspect of the invention, a method of balancing a kitchen knife is disclosed. The method includes configuring the knife to have a blade, a handle defining a hollow compartment therein and one or more weights sized to fit within the hollow compartment. In addition, the method includes establishing access to the hollow compartment such that the weight (or weights) can only be added through the back or rear end of the handle that is axially opposite the blade, then situating the weight(s) in a predetermined axial position in the hollow compartment. As few or as many weights, including weights of different sizes, may be incorporated by the user until a balance deemed suitable to the user is arrived at.

Optionally, situating the weight includes defining a bore through the weight and mounting the weight onto a rod or related member such that the bore cooperates with the rod to keep the weight in a preferred position. Such arrangement promotes a secure connection between them. The mounting between the at least one weight and weight mounting device can be achieved by friction fit, slip fit, threaded connection or other approach discussed herein, where tubes or related sleeves can be slipped over the rod and used to keep the weights in a preferred location on the rod in slip fit configurations. Such applies whether the weight is a single weight or numerous weights. As discussed with the previous aspects, the blade and the handle may be formed from or into a single-piece structure. Also as discussed in conjunction with the previous aspects, the hollow compartment may be closed at its terminal end. A weight mounting assembly can be used to secure the one or more weights within the handle, as well as close off the terminal end of the handle. The assembly may include a handle-engaging member (for example, a ring or related device to couple the back or interior surface of the handle to the rest of the assembly), an anchor member and a rod that is coupled to or otherwise supported by the anchor member. The assembly may additionally include an end cap that may be friction fit, threaded, keyed or otherwise joinable to other components within the weight mounting assembly. For example, by being threadably attached to the anchor member, a user desirous of changing the balance of the knife, may unscrew the end cap and anchor member to allow exposure of the rod and other components used to carry and position the weights. Specifically, the anchor member acts as a base for the rod, elongate tube, post or screw in such a way as to have the rod extend in an axially forward direction into the hollow compartment. As previously discussed, closing the hollow compartment may be achieved by placing the removable parts of the assembly into the hollow compartment that is defined in the handle, and attaching such parts to the handle-engaging member. Thus, in a preferred form, at least the parts of the assembly used to support the weights (for example, the rod and the stopper or anchor, to which the rod and weights may be attached) is removable from the handle. In this way, when a user desires to make rapid, small-scale changes to the knife's balance, he or she need merely remove such parts, add or remove weights, then reinsert those parts of the assembly into the handle.

BRIEF DESCRIPTION OF THE DRAWINGS

The following detailed description of the present invention can be best understood when read in conjunction with the following drawings, where like structure is indicated with like reference numerals and in which.

DETAILED DESCRIPTION OF THE PREFERRED EMBODIMENT

Figure 1A:
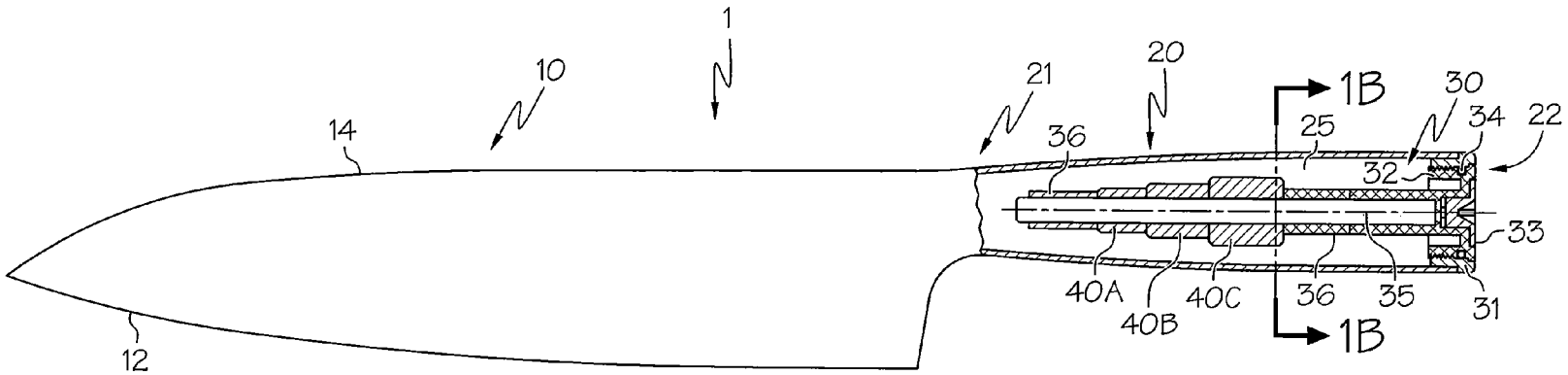
FIG. 1A is a partial elevation cutaway view of a knife with blade and handle according to an embodiment of the present invention.
Figure 1C:
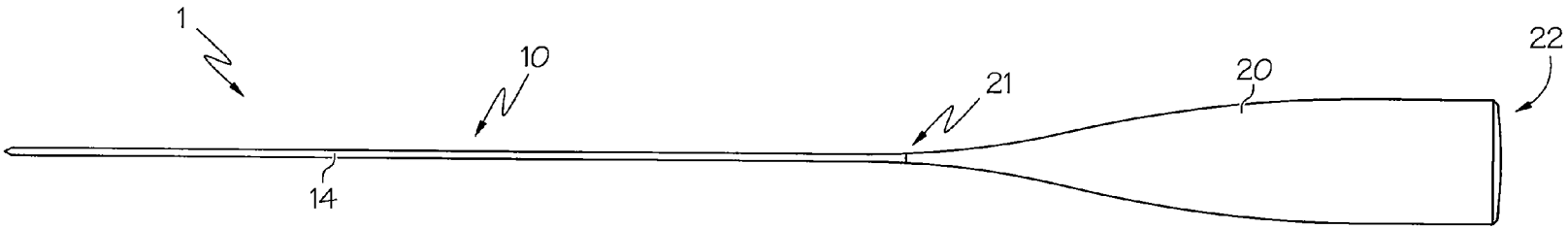
FIG. 1C is a top view of the knife of FIG. 1A.

Referring to the figures, a kitchen knife 1 and the various components making it up are shown. Referring with particularity to FIG. 1A, the knife 1 includes a blade 10 with a cutting edge 12 and an opposing spine 14. Referring with particularity to FIG. 1C, the spine 14 generally has a blunted or squared-off edge such that a user can place his or her hand on the spine 14 to stabilize or otherwise guide the knife 1 during use. In one preferred (although not necessary) form, the blade is made from an alloyed steel to give it enhanced hardness or other desirable cutting edge attributes. One such material may be a high-carbon steel.

The knife 1 also includes a handle 20 that is affixed to blade 10. The handle 20 is tapered from its proximal end 22 to its distal end 21, where the distal end 21 smoothly transitions into blade 10. In a preferred form, the blade 10 and handle 20 form a one-piece unitary structure. Such structure can be formed by having the blade 10 and handle 20 be formed from a single piece of material in situations where the blade and handle materials are the same, or joined together (for example, by welding) in situations where the materials are dissimilar. One example of where the handle 20 may be of a dissimilar material to that of the blade 10 is where the handle 20 is made of 304 stainless steel. The handle 20 of the present invention can be formed from a single piece of material that provides its own support structure. In another form, two mirror-image halves with cavities or recesses formed therein may be joined together (such as by welding), and subsequently joined to the blade 10. Such an approach is superior to that where the handle is formed from halves over a tang or related stub shaft and subsequently joined by rivets, screws or related fasteners. Referring again to FIG. 1A, the cavities or recesses of each of the handle halves, when coupled together, allows the handle 20 to define a hollow compartment 25 inside, the volume of which is ample to accommodate one or more weights 40A, 40B and 40C (collectively referred to as 40), as well as the weight mounting assembly 30 that will be discussed in additional detail below.

Figure 2B:
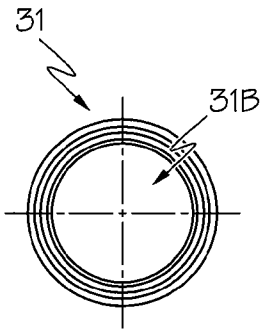
FIG. 2B is an aft looking forward view of the threaded ring of FIG. 2A.
Figure 3A:
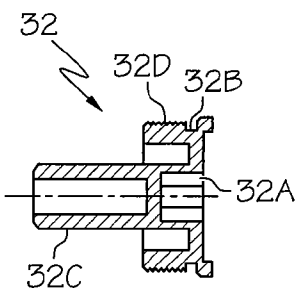
FIG. 3A is a side cutaway view of a stopper that engages the threaded ring and fits within a hollow compartment formed in the handle.
Figure 2A:
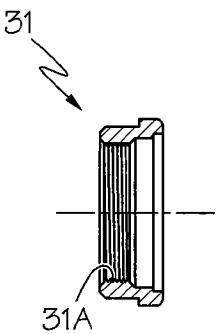
FIG. 2A is a side cutaway view of a threaded ring that fits into a proximal end of the handle.
Figure 3B:
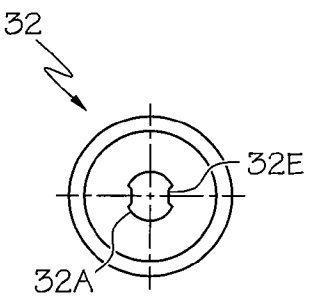
FIG. 3B is an aft looking forward view of the stopper of FIG. 3A.
Figure 6A:
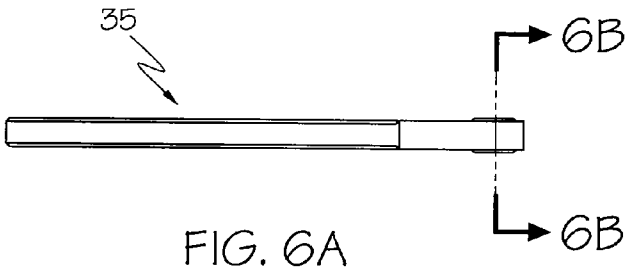
FIG. 6A is a side view of a rod supported by the stopper of FIGS. 3A and 3B.
Figure 6B:
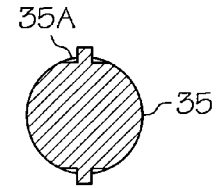
FIG. 6B is an end view along section 6B-6B of FIG. 6A.

To assemble the knife, the blade 10 is joined together with the handle 20 by welding or related joining process known to those skilled in the art. After welding, the weld line can be removed by grinding and polishing, giving the knife 1 the look and mechanical integrity of a single piece unitary structure. Once the handle 20 is made by two separated stainless steel pieces and welded together, a ring 31 (which is shown in isolated form in FIGS. 2A and 2B) or related handle-engaging device is welded, screwed or otherwise affixed at the proximal end 22 of handle 20. Preferably, ring 31 is made from a rigid, durable material, such as 304 stainless steel. As shown, the ring 31 defines a friction fit with the proximal end 22 of the handle 20, although it will be appreciated that other connection schemes (such as an internally threaded relationship formed between the peripheral surface of ring 31 and a respective surface inside handle 20) capable of effecting a secure fit between the ring 31 and handle 20 may be employed. In such circumstances where the ring 31 is threaded, it will be referred to as threaded ring 31. Again as shown, ring 31 is welded to the proximal end 22 of handle 20 in a permanent connection.

Figure 7A:
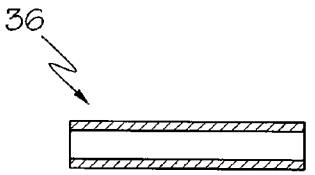
FIG. 7A is a side cutaway view of an indexing tube that engages the rod of FIGS. 6A and 6B.
Figure 7B:
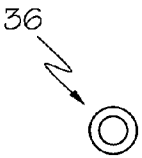
FIG. 7B is an end view of the indexing tube of FIG. 7A.
Figure 9:
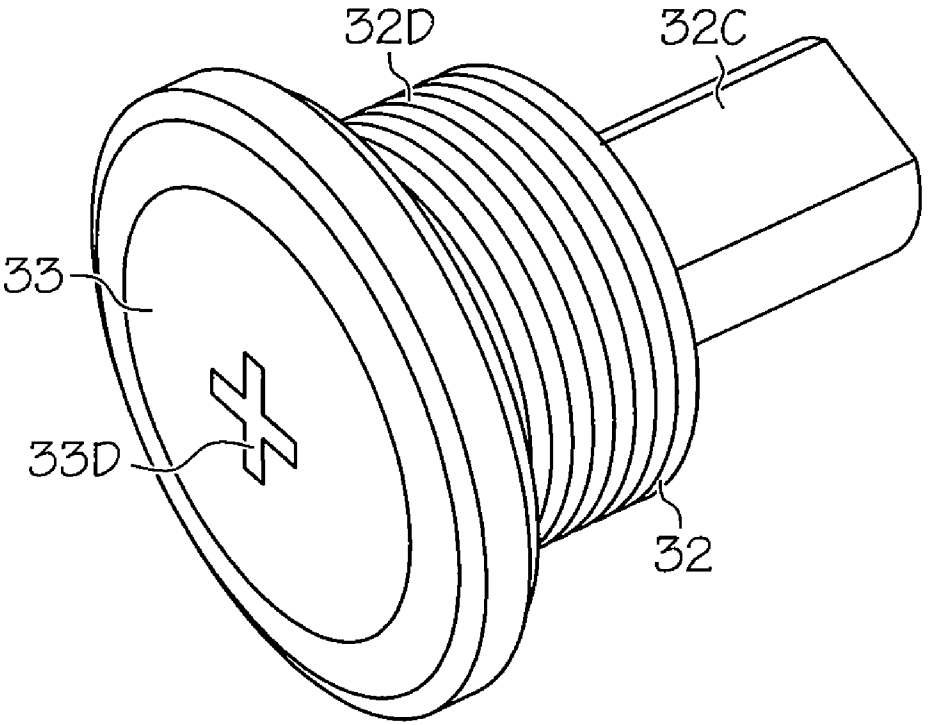
FIG. 9 is a perspective view of the stopper of FIGS. 3A and 3B with the cover of FIGS. 4A and 4B attached.

Referring next to FIGS. 2A through 7B in conjunction with FIG. 1A, the various components making up the weight mounting assembly 30 are shown. In addition to the aforementioned threaded ring 31 of FIGS. 2A and 2B, the assembly 30 includes a stopper or anchor member 32 (as shown in FIGS. 3A and 3B), end cap or cover 33 (as shown in FIGS. 4A and 4B), sealing ring 34 (as shown in FIGS. 5A and 5B), rod 35 (as shown in FIGS. 6A and 6B) and sleeve (or tube) 36 (as shown in FIGS. 7A and 7B). Stopper 32 may be made of a hard, durable, bacterial-resistant material (such as nylon), while sealing ring 34 may be made of rubber or related compliant material. Stopper 32 (which is shown in isolated form in FIGS. 3A and 3B) is placed within the aperture 31B formed in threaded ring 31. Whereas the preferred connection between the threaded ring 31 and the handle 20 is through a permanent affixation (such as welding), the connection between the stopper 32 and threaded ring 31 is preferably through a threaded connection of internal threads 31A on threaded ring 31 (shown with particularity in FIG. 2A) with the external threads 32D on stopper 32 (shown with particularity in FIGS. 3A and 9). As will be discussed in more detail below, such threaded connection facilitates ease of insertion and removal of the weight mounting assembly 30.

To help isolate the hollow compartment 25 from the ambient environment, sealing ring 34 (which is shown in isolated form in FIGS. 5A and 5B) is placed within recess 32B of stopper 32. Sealing ring 34 is made of a compliant material, such as rubber or silicone. By being slightly oversized relative to the fit between the stopper 32 and threaded ring 31, the sealing ring 34 becomes compressed, which in turn provides an interference that inhibits the passage of fluids. A proximal end of stopper 32 includes a recess 32A that can be used to accommodate a cover 33 (which is shown in isolated form in FIGS. 4A and 4B) to effect an aesthetically-pleasing closure to the proximal end 22 of handle 20. A distal end of stopper 32 includes a generally axially-oriented anchor region 32C into which rod 35 (which is shown in isolated form in FIGS. 6A and 6B) fits. To promote secure connection between rod 35 and anchor region 32C, the proximal end of rod 35 may be keyed 35A such that it can fit within a complementary slot (not shown) in anchor region 32C. In another version (not shown), both the proximal outer surface of the end of rod 35 and the inner surface of the anchor region 32C can include complementary threads. Rod 35 is preferably made from a rigid structural material, such as an iron-based material. In addition, it may be nickel plated for smooth finish and enhanced resistance to corrosion.

Figure 1B:
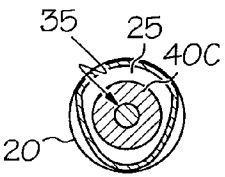
FIG. 1B is an end view along section 1B-1B of FIG. 1A.
Figure 4B:
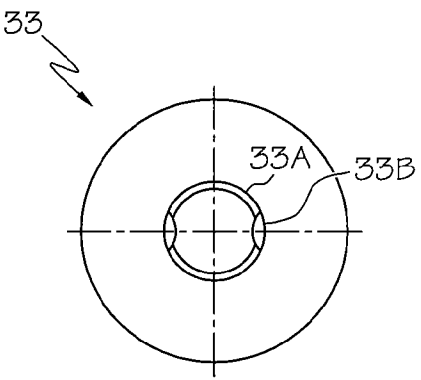
FIG. 4B is a forward looking aft view of the cover of FIG. 4A.
Figure 4A:
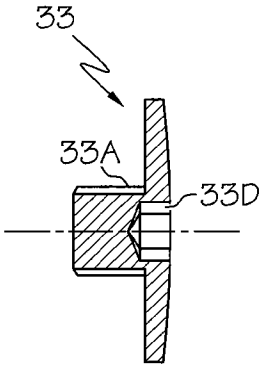
FIG. 4A is a side cutaway view of a cover that engages the stopper of FIGS. 3A and 3B.
Figure 5A:
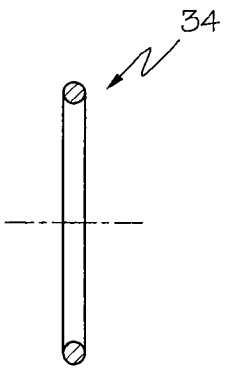
FIG. 5A is a side cutaway view of a sealing ring that fits between the threaded ring and stopper.
Figure 5B:
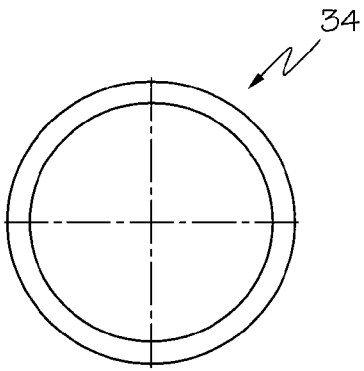
FIG. 5B is an axial view of the sealing ring of FIG. 5A.
Figure 8A:
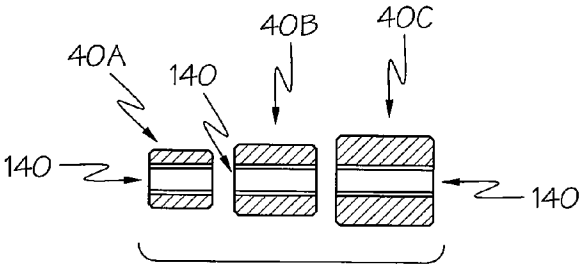
FIG. 8A is a side cutaway view of three separately-sized weights that are supported by the rod of FIGS. 6A and 6B and held in axial place by the indexing tubes of FIGS. 7A and 7B.
Figure 8B:
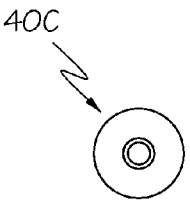
FIG. 8B is an end view of the largest of the weights of FIG. 8A.

Also as shown in FIG. 1A, in conjunction with FIG. 1B and FIGS. 8A and 8B, one or more weights 40A, 40B and 40C can be placed within hollow compartment 25 to allow a user to vary the balance attributes of knife 1. The weights 40A, 40B and 40C are secured to the handle 20 through the weight mounting assembly 30 in general, and rod 35 in particular. Weights 40A, 40B and 40C can be made of any relatively dense material (such as steel or other iron-based material). In a particular form, they can be made of a nickel plated iron in a manner similar to rod 35. As can be seen with particularity in FIG. 1B, the weights 40 (of which only the most proximally-mounted weight 40C can be seen) are horizontally and vertically centered within hollow compartment 25. Rod 35 (which will be discussed in more detail below) extends along the longitudinal (i.e., axial) dimension of the handle 20 and blade 10 of the knife 1.

Weights 40 are of generally cylindrical construction, and define an axial bore 140 therethrough. The relationship between the axial bore 140 and the rod 35 is such that placing the weights 40 on the rod 35 is akin to stringing beads in that one or more of the weights 40 are stacked relative to one another along the rod 35 until a user-determined heft and axial balance is achieved. The attachment of one or more sleeves 36 (two of which are shown in FIG. 1A axially surrounding weights 40A, 40B and 40C) to the rod 35 prevents the sort of free-floating movement of the weights 40 along the rod 35 that would otherwise upset the user's much sought-after balance. Sleeve 36 can in one form be made of rubber that can have a relative high coefficient of friction when disposed against rod 35. By proper choice of aperture size and material choice, a relative ease of positioning of the sleeve 36 can be effected by the user, while remaining a relatively immovable connection to the rod 35 once put into place. In this way, the sleeve 36 acts to limit the axial or longitudinal travel of the weights 40A, 40B and 40C. The present inventors have recognized that another way to achieve the stopping or locking effect of the sleeves is to include radially-extending detents or related protrusions (neither of which are shown) from the rod 35; such can act to limit the axial travel of the weights 40A, 40B and 40C and concomitant imbalances that arise out of an otherwise loose or sloppy connection.

To adjust the weight of the handle 20, the user removes the cover (i.e., end cap) 33 to gain access to stopper 32 and the rod 35 and weights 40 mounted on the stopper 32. Referring with particularity to FIGS. 3A, 3B, 4A, 4B and 9, engagement of cover 33 and stopper 32 is shown. In a preferred form, cover 33 is made from stainless steel. Cover 33 includes an axially-projecting flange 33A that is sized to securely fit within recess 32A of stopper 32. Flange 33A preferably includes keyed members 33B that fit into complementary indents 32E formed along recess 32A. In addition, cover 33 defines a centrally disposed tool access 33D, shown presently in the form of a recess capable of receiving a tool. In the form shown in FIG. 9, the tool access 33D is a screwdriver slot (for example, to accept a Phillips head screwdriver). In this way, the cover 33, which is attached to the stopper 32 by keyed members 33B, can be used as the mechanism with which a screwdriver interacts to allow insertion and removal of the weight mounting assembly 30, as screwing and unscrewing the cover 33 has the effect of transferring such motion that is imparted to the keyed attachment to the stopper 32, which by virtue of its threadable attachment to the inner surface of threaded ring 31, screws to and unscrews from the handle 20, exposing the hollow compartment 25 therein.

Figure 10:
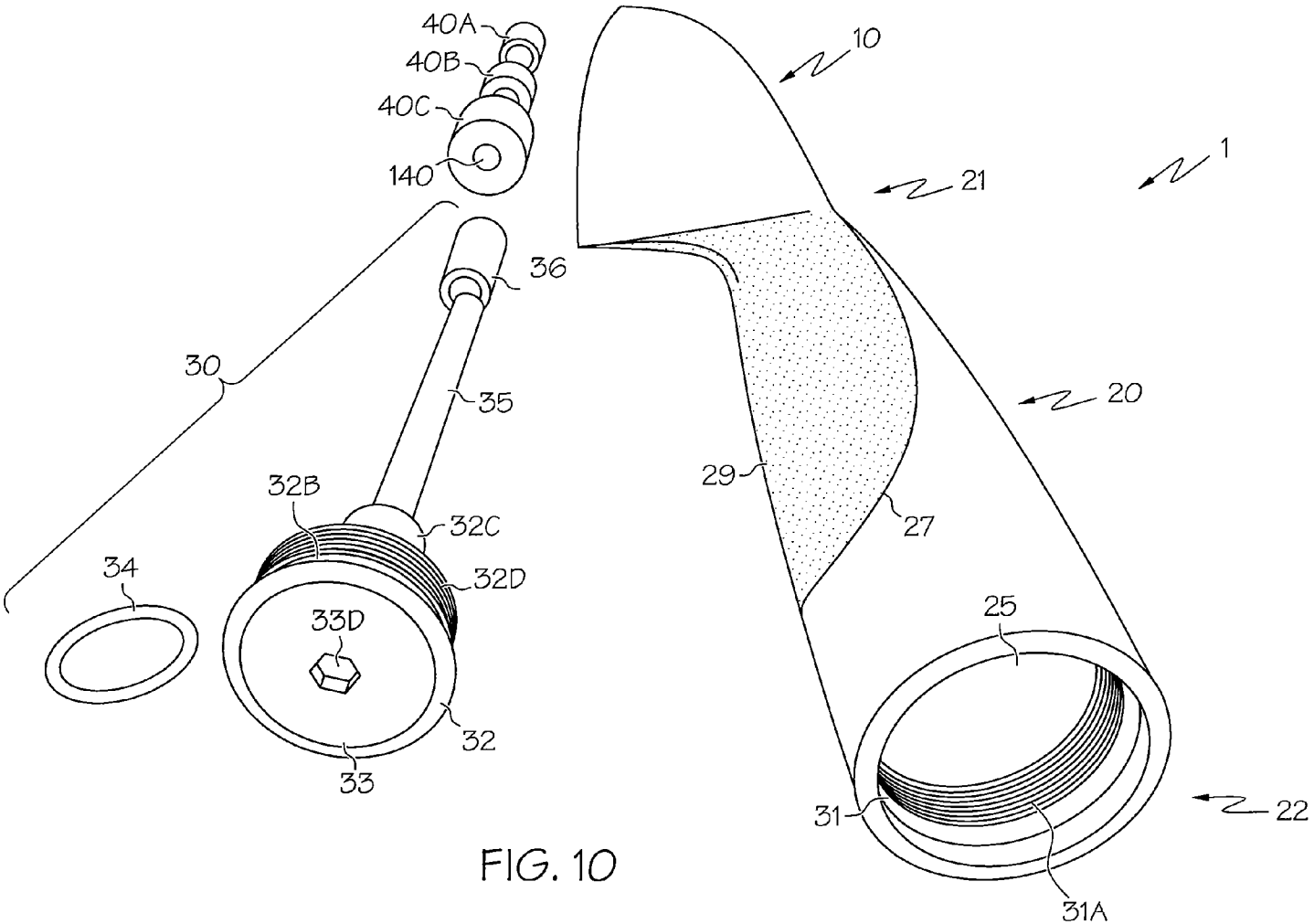
FIG. 10 is a rear partially disassembled view showing the various components making up an embodiment of the kitchen knife of the present invention.

Referring lastly to FIG. 10, an aft-looking-forward view of knife 1 and the various components used to allow the knife 1 to possess weight-balancing features is shown. Particular contouring on the handle 20 can be seen, where a ridgeline 27 extends rearwardly from the distal end 21 of the handle 20 to a location intermediate the distal end 21 and the proximal end 22. To improve the tactile feel of knife 1, a roughened grip portion 29 may be defined on a portion of handle 20; such portion may coincide with an area on one side of the ridgeline 27. The hollow compartment 25 is defined within handle 20, and terminates at its proximal (i.e., rearward) end with the threaded ring 31. As stated above, the engagement of the threaded ring 31 to the handle 20 can be through welding, although friction fitting, screwing or other approaches may also be used. Internal threads 31A on threaded ring 31 cooperate with the external threads 32D on stopper 32 such that the former and latter can removably engage one another. In the version of cover 33 shown in FIG. 10, the centrally disposed tool access 33D is in the form of a recess capable of receiving an Allen wrench. The weight mounting assembly 30 is shown mostly assembled, with stopper 32, cover 33 and rod 35 connected. Weights 40A, 40B and 40C can be mounted onto the rod 35 and affixed axially along the rod 35 by placement of the sleeves 36 axially forward and aft of the weights. Rod 35 may include threads (not shown) to promote a more secure placement of the weights 40 or sleeves 36.

Having described the present invention in detail and by reference to the embodiments thereof, it will be apparent that modifications and variations are possible without departing from the scope of the invention in the following claims.

What is claimed is:

1. A method of balancing a kitchen knife, said method comprising:

configuring said knife to have a blade and a handle formed together to define a unitary construction thereby such that there is no substantial discontinuity formed between said blade and said handle, said handle defining a hollow compartment therein and at least one weight sized to fit within said hollow compartment;

establishing access to said hollow compartment such that said at least one weight can only be added through an open end of said handle that is axially opposite said blade; and situating said at least one weight in a user-determined variable axial position in said hollow compartment such that a substantial entirety of said at least one weight is disposed in said hollow compartment, wherein said at least one weight is fixed in said axial position, and wherein said at least one weight is selectively positionable and fixable in said hollow compartment in different axial positions along substantially the entire length of the handle to substantially adjust the balance of the knife including a position in which the entire weight is axially spaced from said open end of said handle.

2. The method of claim 1, wherein said situating said at least one weight comprises defining a bore through said at least one weight and mounting said at least one weight onto a rod such that said bore cooperates therewith.

3. The method of claim 2, wherein said mounting comprises establishing at least one of a friction fit, a sliding fit and a threaded connection between said at least one weight and said rod.

4. The method of claim 1, wherein said at least one weight comprises a plurality of weights.

5. The method of claim 4, wherein said situating comprises adding or removing said weights to establish a predetermined axial balance in said knife.

6. The method of claim 1, further comprising securing said at least one weight within said hollow compartment with a weight mounting assembly, said weight mounting assembly comprising at least a handle-engaging member, an anchor member and a rod supported by said anchor member, said weight mounting assembly removably connectable to said handle.

7. The method of claim 6, wherein said weight mounting assembly further comprises a sealing ring mounted on said anchor member, said sealing ring configured to substantially isolate said hollow compartment from the ambient environment.

8. The method of claim 6, wherein said weight mounting assembly is threadably attached to said handle.

9. The method of claim 6, wherein said weight mounting assembly further comprises an end cap disposed on said open end of said handle.

* * * * *